US008443611B2

(12) United States Patent
Belsom et al.

(10) Patent No.: US 8,443,611 B2
(45) Date of Patent: May 21, 2013

(54) SYSTEM AND METHOD FOR DAMPING COMBUSTOR NOZZLE VIBRATIONS

(75) Inventors: Keith C. Belsom, Laurens, SC (US); Bruce John Badding, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/228,634

(22) Filed: Sep. 9, 2011

(65) Prior Publication Data

US 2013/0062425 A1 Mar. 14, 2013

(51) Int. Cl.
*F02C 1/00* (2006.01)

(52) U.S. Cl.
USPC ..... 60/772; 60/725

(58) Field of Classification Search
USPC ..... 60/725, 737, 740, 746, 748, 772, 60/39.37; 431/114; 413/114
See application file for complete search history.

(56) References Cited

U.S. PATENT DOCUMENTS

| | | | | |
|---|---|---|---|---|
| 5,219,144 | A | 6/1993 | Fox et al. | |
| 6,422,083 | B1 | 7/2002 | Hobbs | |
| 6,461,148 | B1 * | 10/2002 | Scotto et al. | 431/215 |
| 6,827,551 | B1 | 12/2004 | Duffy et al. | |
| 6,857,615 | B2 | 2/2005 | Puckett et al. | |
| 8,087,228 | B2 * | 1/2012 | McMahan et al. | 60/39.37 |
| 2003/0051478 | A1 * | 3/2003 | Matsuyama et al. | 60/725 |
| 2008/0053097 | A1 * | 3/2008 | Han et al. | 60/737 |
| 2010/0011769 | A1 * | 1/2010 | Gambacorta et al. | 60/725 |
| 2010/0077755 | A1 * | 4/2010 | Jangili et al. | 60/725 |
| 2010/0293952 | A1 * | 11/2010 | Jain et al. | 60/725 |
| 2011/0100016 | A1 * | 5/2011 | Cihlar et al. | 60/772 |

* cited by examiner

*Primary Examiner* — Phutthiwat Wongwian
(74) *Attorney, Agent, or Firm* — Dority & Manning, PA

(57) ABSTRACT

A system for damping combustor nozzle vibrations includes an end cover and a combustion chamber downstream from the end cover. First and second sets of nozzles extend axially between the end cover and the combustion chamber. The second set of nozzles is adjacent to the first set of nozzles. The system includes means for damping vibrations between the nozzles with a gap between the means for damping vibrations. A method for damping combustor nozzle vibrations includes flowing a working fluid through first and second sets of nozzles, wherein the first set of nozzles includes a damping member attached to and circumferentially surrounding at least a portion of the first set of nozzles, and contacting at least one nozzle in the second set of nozzles with the damping member on at least one nozzle in the first set of nozzles.

20 Claims, 7 Drawing Sheets

SYSTEM AND METHOD FOR DAMPING COMBUSTOR NOZZLE VIBRATIONS

FIELD OF THE INVENTION

The present invention generally involves a system and method for damping combustor nozzle vibrations.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Many combustor components are subject to high vibration environments which can lead to increased wear, cracking, premature failure, pressure oscillations, flow oscillations, or other undesirable effects. For example, combustor nozzles are often attached to an end cover at one end and extend toward the combustion chamber at the other end. Base excitation, working fluid or fuel perturbations, or any other source may produce natural frequencies or other forced frequencies in the nozzles that cause the nozzles to vibrate. The vibrations in turn may lead to detrimental wear, fatigue cracking, tones, or other undesirable effects in the combustor and/or downstream components. Design clearances between the nozzles and support structures that allow for thermal growth and manufacturing tolerances make it difficult to damp the vibrations. Therefore, an improved system and method for damping combustor nozzle vibrations would be useful.

BRIEF DESCRIPTION OF THE INVENTION

Aspects and advantages of the invention are set forth below in the following description, or may be obvious from the description, or may be learned through practice of the invention.

One embodiment of the present invention is a system for damping combustor nozzle vibrations. The system includes an end cover that extends radially across at least a portion of the combustor and a combustion chamber downstream from the end cover. A first set of nozzles extends axially between the end cover and the combustion chamber, and a second set of nozzles extends axially between the end cover and the combustion chamber, wherein the second set of nozzles is adjacent to the first set of nozzles. The system includes means for damping vibrations between the first and second sets of nozzles with a gap between the means for damping vibrations and the second set of nozzles.

Another embodiment of the present invention is a system for damping combustor nozzle vibrations that includes an end cover that extends radially across at least a portion of the combustor, a combustion chamber downstream from the end cover, a first set of nozzles that extends axially between the end cover and the combustion chamber, and a second set of nozzles that extends axially between the end cover and the combustion chamber, wherein the second set of nozzles is adjacent to the first set of nozzles. A first damping member is attached to and circumferentially surrounds at least a portion of the first set of nozzles, wherein the first damping member damps vibrations between the first and second sets of nozzles, and a gap is between the first damping member and the second set of nozzles.

The present invention may also include a method for damping combustor nozzle vibrations that includes flowing a working fluid through a first set of nozzles, wherein the first set of nozzles includes a first damping member attached to and circumferentially surrounding at least a portion of the first set of nozzles. The method also includes flowing the working fluid through a second set of nozzles, wherein the second set of nozzles is adjacent to and spaced apart from the first set of nozzles, and contacting at least one nozzle in the second set of nozzles with the first damping member on at least one nozzle in the first set of nozzles.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
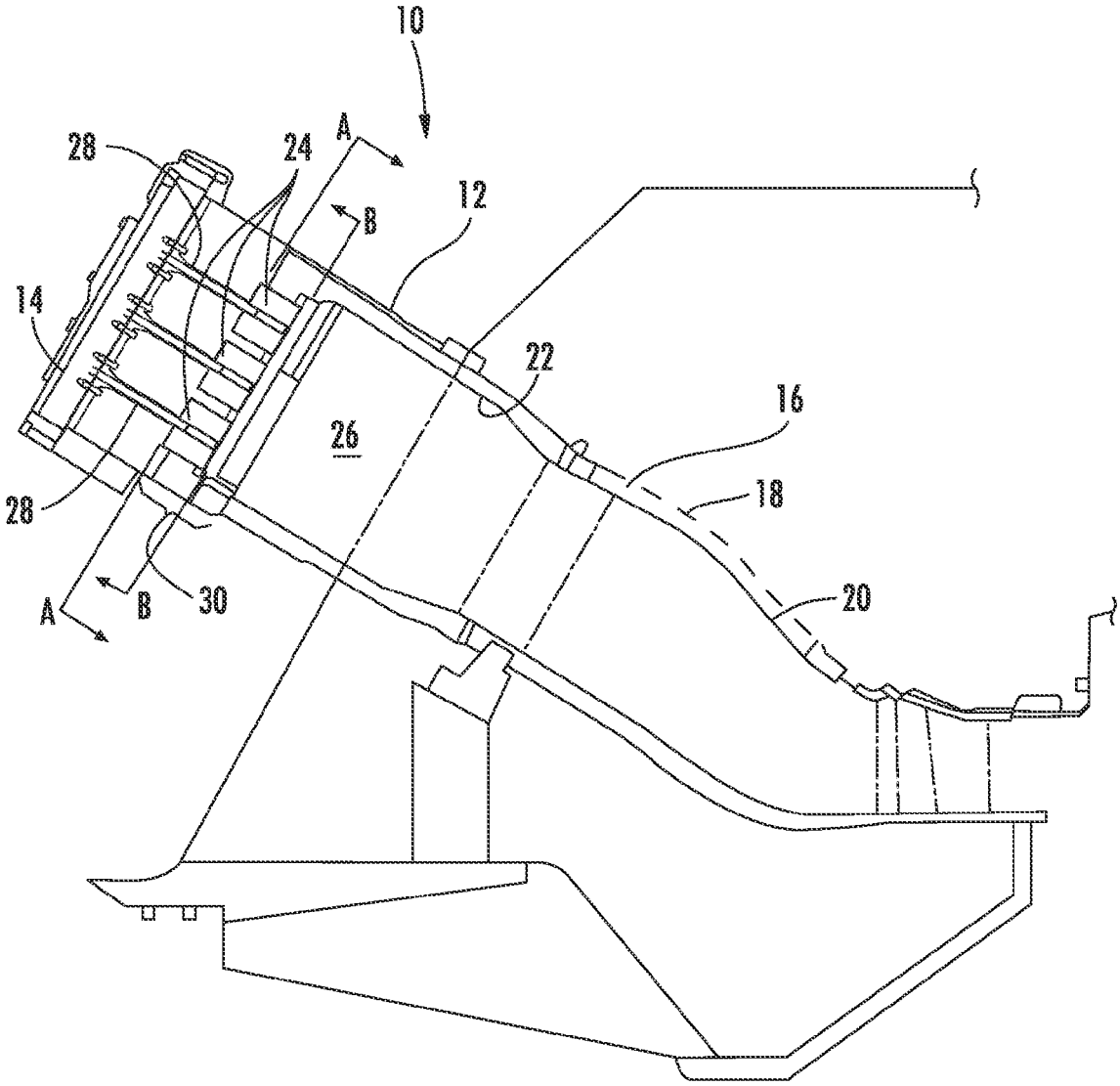
FIG. 1 is a simplified cross-section view of an exemplary combustor according to an embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for damping combustor nozzle vibrations. In particular embodiments, a plurality of nozzles may be arranged into a first set and a second set, with each set including one or more nozzles. As used herein, the terms "first", "second", and "third" may be used interchangeably to distinguish one component from another and are not intended to signify location or importance of the individual components. At least one of the first or second sets of nozzles may include a damper, impact surface, contact patch, damping member, or other means for damping vibrations between the first and second sets of nozzles. As one or more nozzles in the first or second sets of nozzles vibrate, contact with the damper, impact surface, contact patch, damping member, or other means disrupts the frequency of vibration, effectively damping the vibrations between the first and second sets of nozzles. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section view of an exemplary combustor 10, such as would be included in a gas turbine, according to various embodiments of the present invention. A casing 12 may surround the combustor 10 and an end cover 14 may extend radially across at least a portion of the combustor 10 so that the casing 12 and end cover 14 combine to contain a working fluid flowing to the combustor 10. The working fluid may pass, for example, through flow holes 16 in an impingement sleeve 18 to flow along the outside of a transition piece 20 and liner 22 to provide convective cooling to the transition piece 20 and liner 22. When the working fluid reaches the end cover 14, the working fluid reverses direction to flow through a plurality of nozzles 24 into a downstream combustion chamber 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

The nozzles 24 extend generally axially between the end cover 14 and the combustion chamber 26. As shown in FIG. 1, each nozzle 24 may include a fuel conduit 28 fixedly attached to the end cover 14. The fuel conduit 28 may provide fluid communication for fuel and/or other additives to flow through the end cover 14 and nozzles 24 and into the combustion chamber 26. Alternately, or in addition, the nozzles 24 may be fixedly attached to an end cap 30 axially located between the end cover 14 and the combustion chamber 26, and fuel and/or other additives may be supplied to the nozzles 24 through a fuel conduit that circumferentially surrounds the combustor 10.

Figure 2:
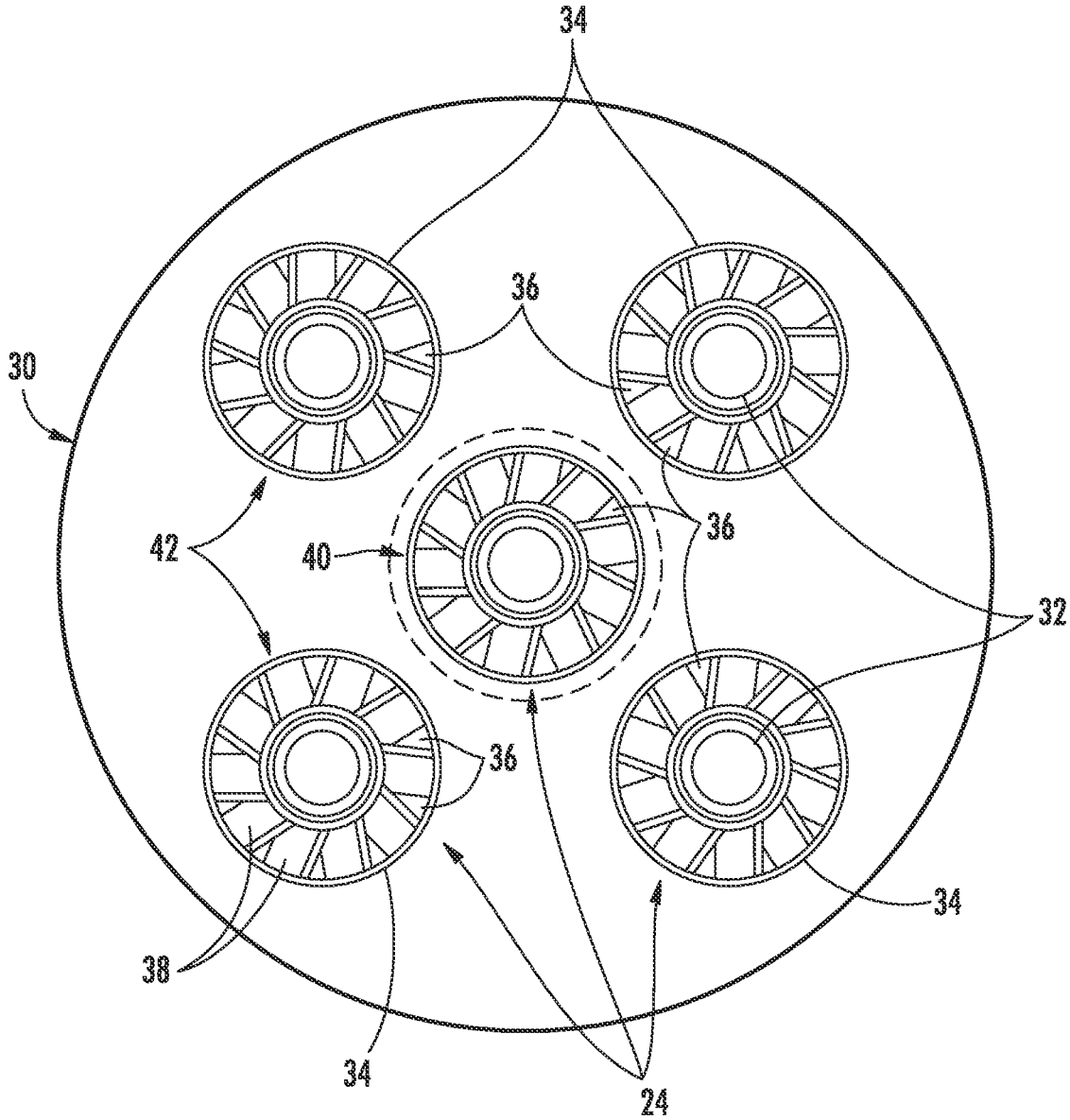
FIG. 2 is a downstream plan view of an embodiment of the end cap shown in FIG. 1 taken along line A-A.
Figure 3:
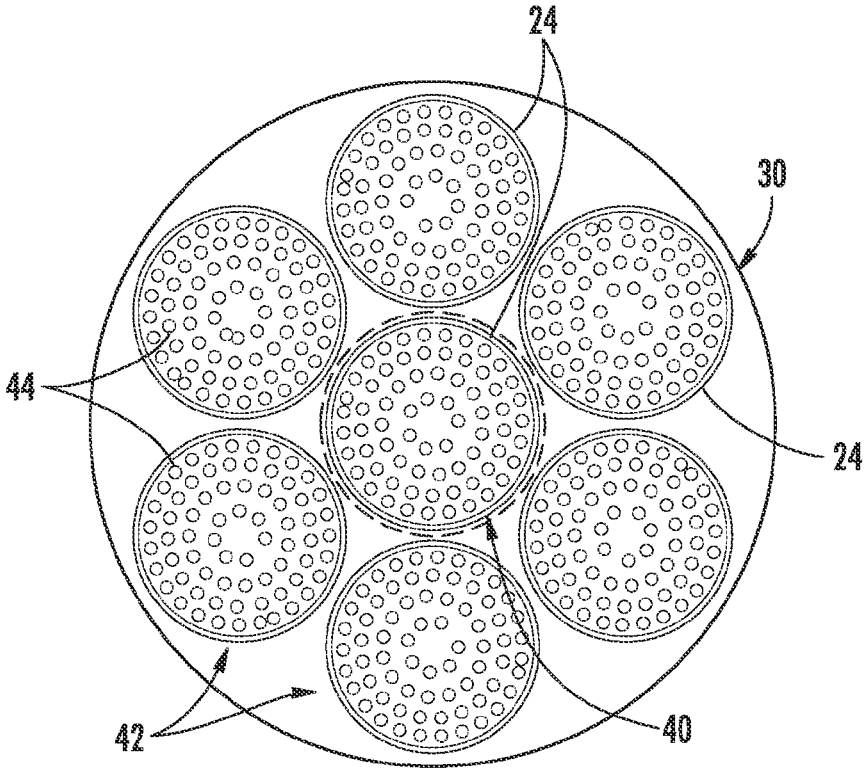
FIG. 3 is a downstream plan view of an alternate embodiment of the end cap shown in FIG. 1 taken along line A-A.
Figure 4:
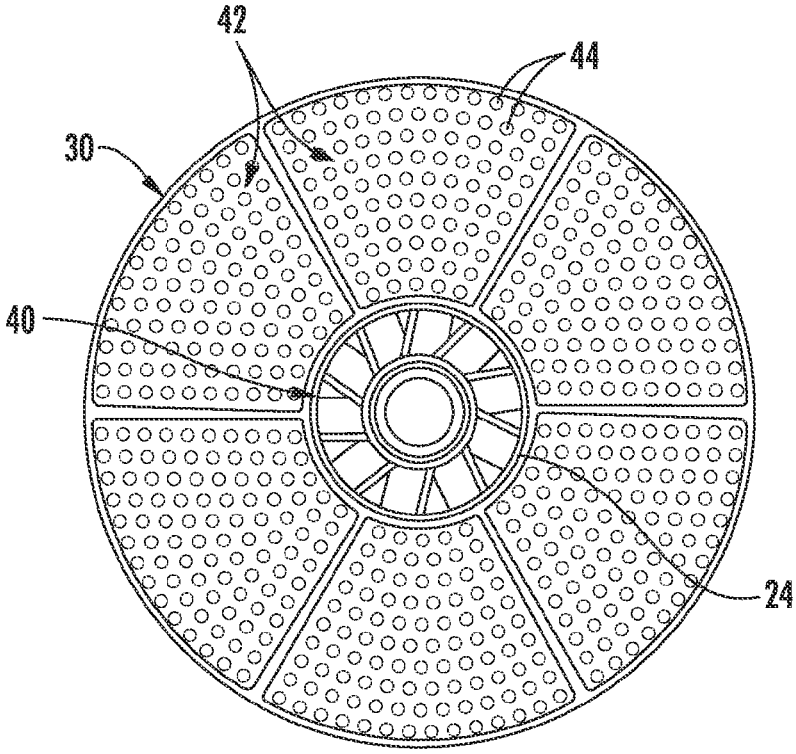
FIG. 4 is a downstream plan view of an alternate embodiment of the end cap shown in FIG. 1 taken along line A-A.

Various embodiments of the combustor 10 may include different types, shapes, and arrangements of nozzles 24 separated or grouped into various sets across the end cap 30, and FIGS. 2-4 provide downstream plan views of various embodiments of the end cap 30 shown in FIG. 1 taken along line A-A. In the embodiment shown in FIG. 2, for example, each nozzle 24 may include a center body 32, a shroud 34 surrounding at least a portion of the center body 32, and an annular passage 36 between the center body 32 and the shroud 34. The annular passage 36 provides fluid communication for the working fluid to flow through the end cap 30 and into the combustion chamber 26. In addition, the center body 32 receives fuel from the fuel conduit 28 and provides fluid communication for the fuel to flow through the annular passage 36 and into the combustion chamber 26. Each nozzle 24 may further include a plurality of swirler vanes 38 to impart swirl to the working fluid and fuel flowing through the annular passage 34. As shown in FIG. 2, the nozzles 24 may be separated or grouped into a first set 40, having a single nozzle 24, with a second set 42, having four nozzles 24, adjacent to and circumferentially surrounding the first set 40 of nozzles 24.

Alternately, as illustrated in the embodiment shown in FIG. 3, each nozzle 24 may include a plurality of premixer tubes 44 that receive fuel from the fuel conduit 28 and provide fluid communication for the working fluid and/or fuel to flow through the end cap 30 and into the combustion chamber 26. As shown in FIG. 3, the second set 40 of nozzles 24, having six nozzles 24, may again circumferentially surround the first set 42 of nozzles 24, having a single nozzle 24.

The particular embodiment shown in FIG. 4 represents a hybrid combination of the embodiments described and illustrated with respect to FIGS. 2 and 3. Specifically, the single nozzle 24 in the first 40 set of nozzles 24 generally conforms to the nozzle 24 design shown and described in FIG. 2, and the pie-shaped nozzles 24 in the second set 42 of nozzles 24 generally conforms to the nozzle 24 design shown and described in FIG. 3. One of ordinary skill in the art will readily appreciate that FIGS. 2-4 provide exemplary arrangements of the various types, shapes, and numbers of nozzles 24, and embodiments of the present invention are not limited to any particular nozzle type, shape, or arrangement unless specifically recited in the claims.

Figure 5:
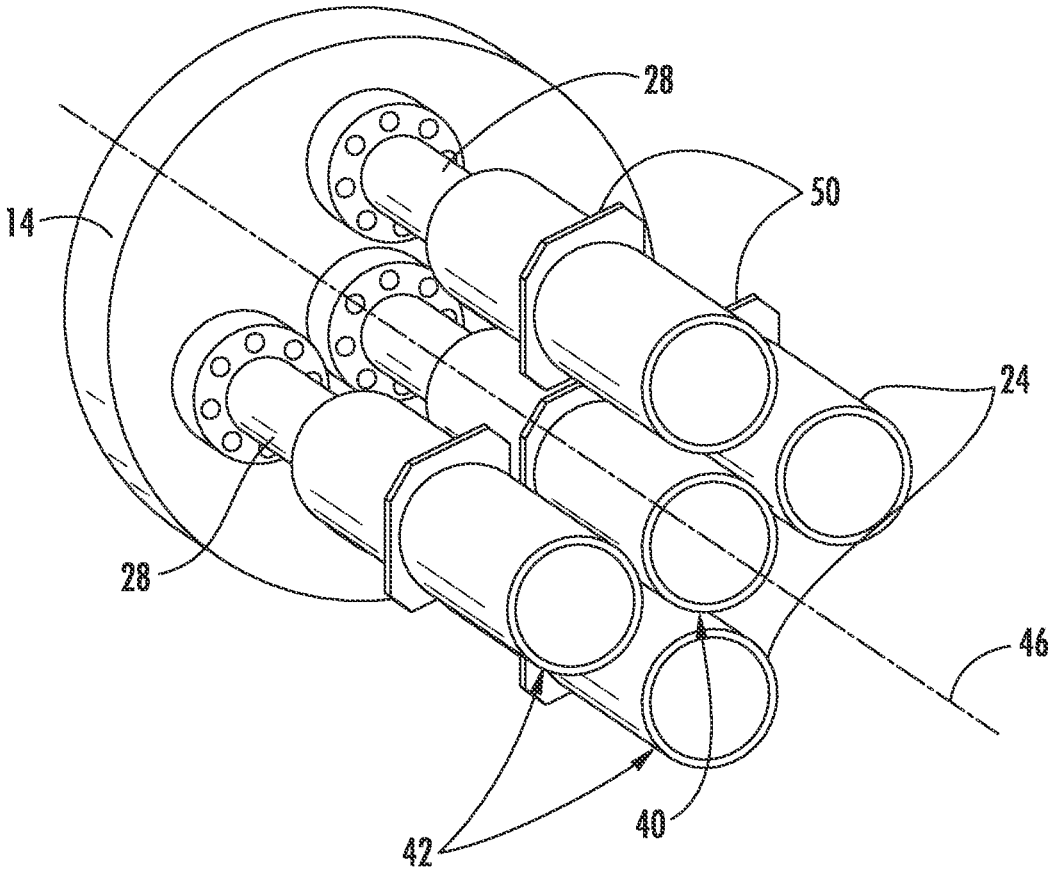
FIG. 5 is a partial perspective view of the end cover and nozzles shown in FIG. 1 according to the first embodiment of the present invention.

FIG. 5 provides a partial perspective view of the end cover 14 and nozzles 24 shown in FIG. 1 according to an embodiment of the present invention. In this particular embodiment, the first set 40 of nozzles 24 includes a single nozzle 24 aligned with an axial centerline 46 of the combustor 10, and the second set 42 of nozzles 24 includes four nozzles 24 adjacent to and circumferentially surrounding the first set 40 of nozzles 24, as in the embodiment shown in FIG. 2. At least a portion of the first and second sets 40, 42 of nozzles 24, specifically the fuel conduit 28 in this embodiment, may be fixedly attached to the end cover 14. The first and second sets 40, 42 of nozzles 24 have a natural or resonant frequency created by a combination of various design parameters and/or operating conditions associated with each nozzle 24. For example, the specific material, stiffness, mass, length, diameter, geometry, and flow rate of each nozzle 24 are non-limiting examples of design parameters and operating conditions that influence the natural or resonant frequency in each nozzle 24. In particular embodiments, the design parameters and/or operating conditions may be specifically selected or adjusted to ensure that the first set 40 of nozzles 24 has a natural frequency that is different from the natural frequency of the second set 42 of nozzles 24 to avoid creating a harmonic frequency that may increase the vibrations in the nozzles 24.

As shown in FIG. 5, one or more of the nozzles 24 includes means for damping vibrations between the first and second sets 40, 42 of nozzles 24. The structure for damping vibrations between the first and second sets 40, 42 of nozzles 24 may include a damper, a contact patch, an impact surface, a damping member, or similar device attached to one or more nozzles 24 in the first and/or second sets 40, 42 of nozzles 24 and capable of continuous exposure to the temperature, pressure, and flow conditions in the combustor 10. For example, the structure may include low or high alloy steels. For example, the structure may include a hardened material known as T800 which includes, by weight, 27-30% molybdenum, 16.5-18.5% chromium, 3-3.8% silicon, less than 1.5% iron, less than 1.5% nickel, less than 0.15% oxygen, less than 0.08% carbon, less than 0.03% phosphorus, less than 0.03% sulfur, and the balance of cobalt. Another suitable material for damping vibrations between the first and second sets 40, 42 of nozzles 24 may include a composition known as WC17Co, which includes tungsten carbide 17 and cobalt. Another suitable composition may be Stellite 6 which includes, by weight, 27-32% chromium, 4-6% tungsten, 0.9-1.4% carbon, 3% nickel, 3% iron, 1.6% silicon, and the balance of cobalt. Yet another suitable composition is known as CM64 which includes, by weight, 26-30% chromium, 4-6% nickel, less than 0.5% molybdenum, 18-21% tungsten+molybdenum, 0.75-1.25% vanadium, 0.005-0.1% boron, 0.7-1% carbon, less than 3% iron, less than 1% manganese, less than 1% bismuth, and the balance of cobalt.

The means for damping vibrations between the first and second sets 40, 42 of nozzles 24 may be attached to one or more nozzles 24 in the first and/or second sets 40, 42 of nozzles 24 in various geometries, and FIGS. 6-9 provide exemplary upstream plan views of alternate embodiments of the end cap 30 shown in FIG. 1 taken along line B-B. As illustrated in each embodiment shown in FIGS. 6-9, the first set 40 of nozzles 24 includes a single nozzle to 24 aligned with the axial centerline 46 of the combustor 10, and the second set 42 of nozzles 24 includes four or more nozzles 24 adjacent to and circumferentially surrounding the first set 40 of nozzles 24. Each embodiment includes a gap 48 between the means for damping and the second set 42 of nozzles 24. The width of the gap 48 is selected to allow each nozzle 24 to move independently of the adjacent nozzles 24 during thermal expansion and contraction while also allowing vibrating nozzles 24 in the second set 42 of nozzles 24 to contact the means for damping. For example, the width of the gap 48 may be approximately 0.001-0.020 inches, although the specific width of the gap 48 is not a limitation of the present invention unless specifically recited in the claims.

Figure 6:
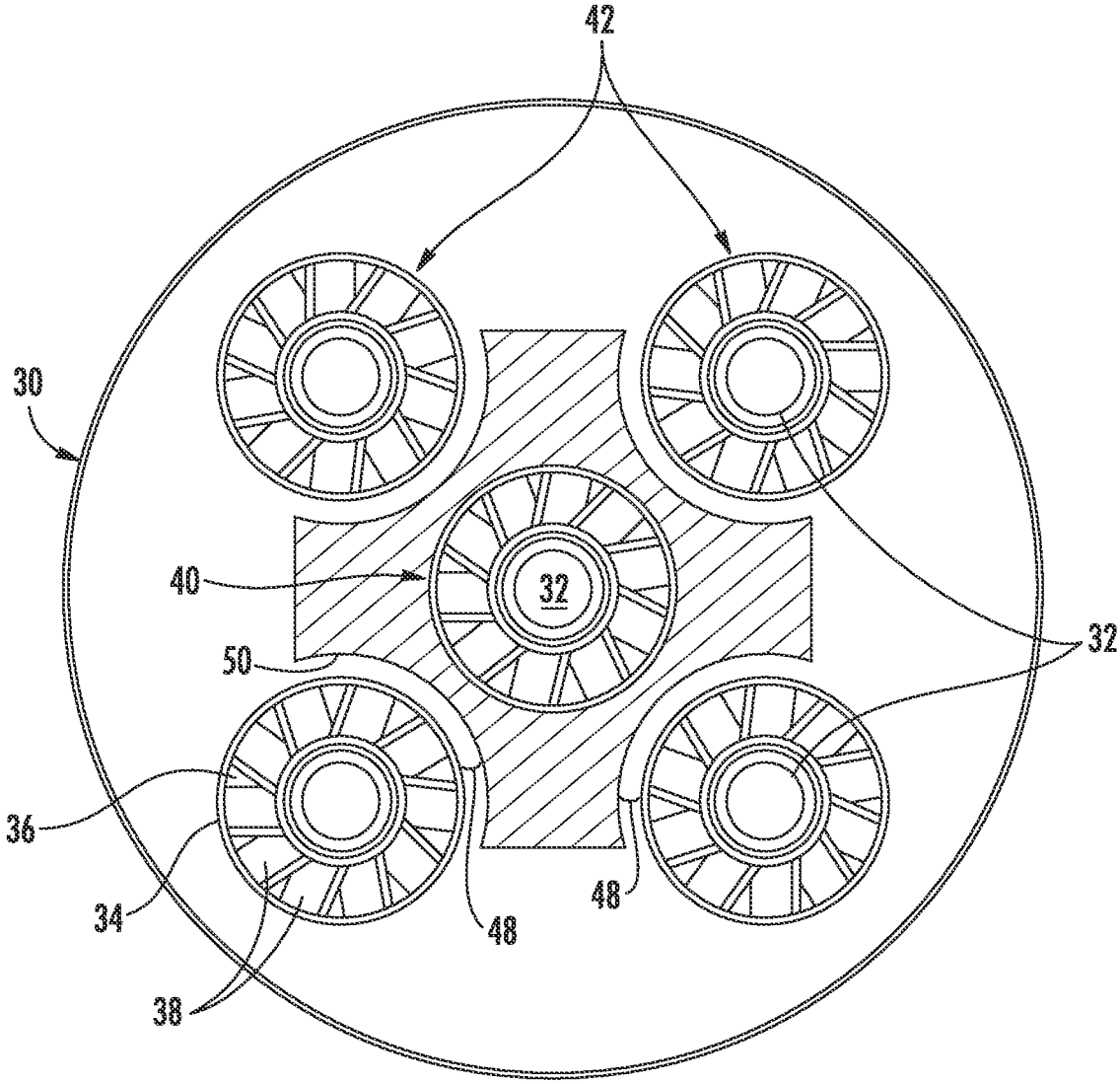
FIG. 6 is an upstream plan view of the end cap shown in FIG. 1 taken along line B-B according to an embodiment of the present invention.
Figure 7:
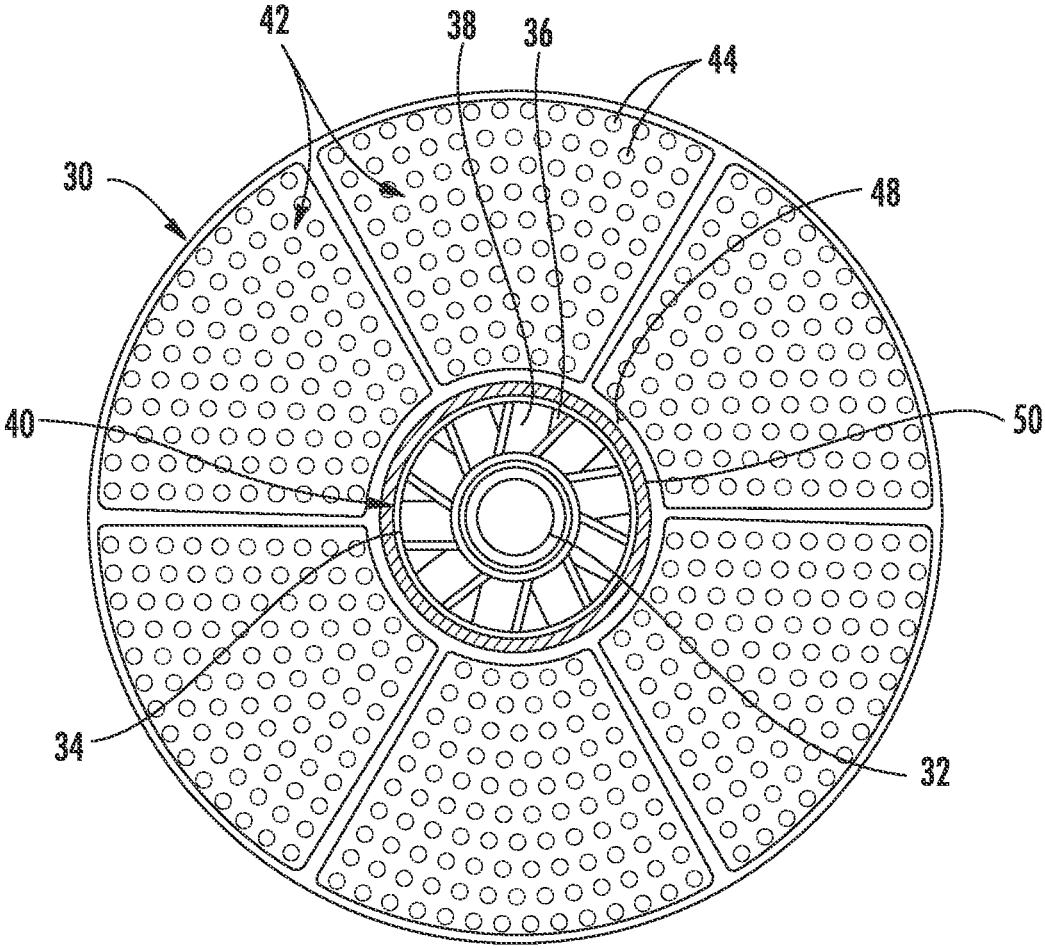
FIG. 7 is an upstream plan view of the end cap shown in FIG. 1 taken along line B-B according to an alternate embodiment of the present invention.

As shown in FIGS. 6, and 7, the means for damping vibrations includes a damping member 50 attached to and circumferentially surrounding the first set 40 of nozzles 24. Although shown as a continuous structure that completely surrounds the first set 40 of nozzles 24, in particular embodiments the damping member 50 may include a plurality of segments circumferentially arranged around the portions of the first set 40 of nozzles 24 that may contact adjacent nozzles 24 in the second set 42 of nozzles 24. As the nozzles 24 in the first and/or second sets 40, 42 vibrate, the movement associated with the vibration results in contact between the damping member 50 and the adjacent nozzles 24 to dissipate or reduce the vibration in each nozzle 24. As shown in FIGS. 6 and 7, the shape of the damping member 50 may substantially match the adjacent contour of the nozzles 24 in the second set 42 of nozzles 24 so that the damping member 50 is substantially tangential to the second set 42 of nozzles 24. This particular geometry increases the surface area of the contact points between the damping member 50 and the second set 42 of nozzles 24 to enhance the damping effect of the damping member 50.

Figure 8:
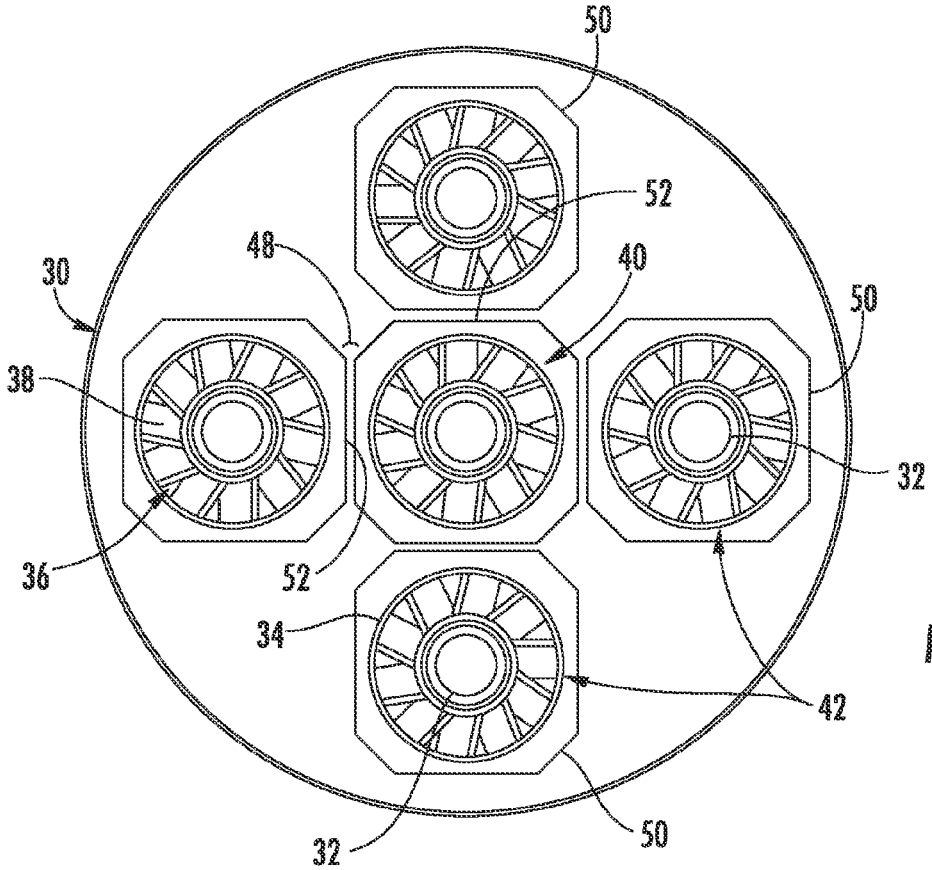
FIG. 8 is an upstream plan view of the end cap shown in FIG. 1 taken along line B-B according to an alternate embodiment of the present invention.
Figure 9:
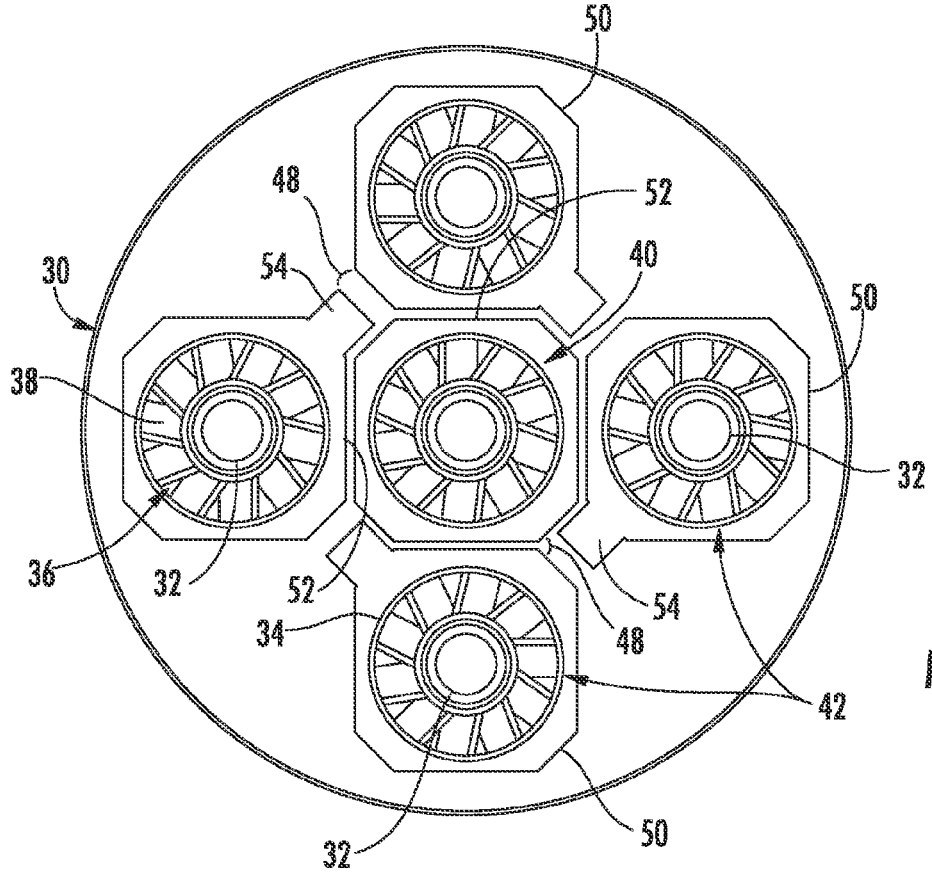
FIG. 9 an upstream plan view of the end cap shown in FIG. 1 taken along line B-B according to an alternate but embodiment of the present invention.

As shown in FIGS. 8 and 9, the means for damping vibrations includes a damping member 50 attached to and circumferentially surrounding each nozzle 24 in both the first and second sets 40, 42 of nozzles 24. Although shown as a continuous structure that completely surrounds each nozzle 24, in particular embodiments each damping member 50 may include a plurality of segments circumferentially arranged around the portions of the nozzles 24 that may contact adjacent nozzles 24. As the nozzles 24 in the first and/or second sets 40, 42 of nozzles 24 vibrate, the movement associated with the vibration results in contact between the damping members 50 of adjacent nozzles 24 to dissipate or reduce the vibration in each nozzle 24. As shown in FIGS. 8 and 9, each damping member 50 may include a substantially flat surface 52 that increases the surface area of the contact points between adjacent damping members 50 to enhance the damping effect of the damping members 50.

In the particular embodiment shown in FIG. 9, each damping member 50 around the second set 42 of nozzles 24 further includes a tab, extension, or second damping member 54 that extends toward adjacent nozzles 24 in the second set 42 of nozzles 24. In this manner, the second damping members 54 attached to the second set 42 of nozzles 24 may impact with adjacent nozzles 24 in the second set 42 of nozzles 24 to damp vibrations between adjacent nozzles 24 in the second set 42 of nozzles 24.

The embodiments previously described with respect to FIGS. 1-9 may thus provide a method for damping combustor nozzle 24 vibrations. The method generally includes flowing the working fluid through the first set 40 of nozzles 24, wherein the first set 40 of nozzles 24 includes the damping member 50 attached to and circumferentially surrounding at least a portion of the first set 40 of nozzles 24. The method further includes flowing the working fluid through the second set 42 of nozzles 24, wherein the second set 42 of nozzles 24 is adjacent to and spaced apart from the first set 40 of nozzles 24. In addition, the method includes contacting at least one nozzle 24 in the second set 42 of nozzles 24 with the damping member 50 on at least one nozzle 24 in the first set 40 of nozzles 24. In particular embodiments, the method may further include contacting at least one nozzle in the second set of nozzles with a damping member 50 attached to and circumferentially surrounding at least a portion of the second set 42 of nozzles 24.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for damping combustor nozzle vibrations, comprising:

a. an end cover that extends radially across at least a portion of the combustor;

b. a combustion chamber downstream from the end cover;

c. a first set of nozzles that extends axially between the end cover and the combustion chamber;

d. a second set of nozzles that extends axially between the end cover and the combustion chamber, wherein the second set of nozzles is adjacent to the first set of nozzles;

e. means for damping vibrations between the first and second sets of nozzles; and f. a gap between the means for damping vibrations and the second set of nozzles, wherein the gap extends continuously around the means for damping vibrations from upstream of the means for damping vibrations to the combustion chamber.

2. The system as in claim 1, wherein at least a portion of the first or second sets of nozzles is fixedly attached to the end cover.

3. The system as in claim 1, wherein the first set of nozzles has a different natural frequency than the second set of nozzles.

4. The system as in claim 1, wherein the means for damping vibrations between the first and second sets of nozzles is substantially tangential to the second set of nozzles.

5. The system as in claim 1, wherein at least one nozzle in the first or second sets of nozzles comprises a plurality of premixer tubes.

6. The system as in claim 1, wherein at least one nozzle in the first or second sets of nozzles comprises a center body, a shroud surrounding at least a portion of the center body, and an annular passage between the center body and the shroud.

7. The system as in claim 1, wherein the second set of nozzles circumferentially surrounds the first set of nozzles.

8. The system as in claim 1, wherein the second set of nozzles comprises a plurality of nozzles and further including means for damping vibrations between the plurality of nozzles in the second set of nozzles.

9. A system for damping combustor nozzle vibrations, comprising:

a. an end cover that extends radially across at least a portion of the combustor;

b. a combustion chamber downstream from the end cover;

c. a first set of nozzles that extends axially between the end cover and the combustion chamber;

d. a second set of nozzles that extends axially between the end cover and the combustion chamber, wherein the second set of nozzles is adjacent to the first set of nozzles;

e. a first damping member attached to and circumferentially surrounding at least a portion of the first set of nozzles, wherein the first damping member damps vibrations between the first and second sets of nozzles; and f. a gap between the first damping member and the second set of nozzles, wherein the gap extends continuously around the first damping member from upstream of the first damping member to the combustion chamber.

10. The system as in claim 9, wherein at least a portion of the first or second sets of nozzles is fixedly attached to the end cover.

11. The system as in claim 9, wherein the damping member comprises at least one of a metal alloy or a cobalt coating.

12. The system as in claim 9, wherein the damping member is substantially tangential to the second set of nozzles.

13. The system as in claim 9, wherein the first set of nozzles has a different natural frequency than the second set of nozzles.

14. The system as in claim 9, wherein at least one nozzle in the first or second sets of nozzles comprises a plurality of premixer tubes.

15. The system as in claim 9, wherein at least one nozzle in the first or second sets of nozzles comprises a center body, a shroud surrounding at least a portion of the center body, and an annular passage between the center body and the shroud.

16. The system as in claim 9, wherein the second set of nozzles circumferentially surrounds the first set of nozzles.

17. The system as in claim 9, further comprising a second damping member attached to and circumferentially surrounding at least a portion of the second set of nozzles, wherein the first and second damping members damp vibrations between the first and second sets of nozzles.

18. The system as in claim 17, wherein the second set of nozzles comprises a plurality of nozzles and wherein the second damping member damps vibrations between the plurality of nozzles in the second set of nozzles.

19. A method for damping combustor nozzle vibrations, comprising:

a. flowing a working fluid through a first set of nozzles, wherein the first set of nozzles includes a first damping member attached to and circumferentially surrounding at least a portion of the first set of nozzles, wherein a gap extends continuously around the first damping member from upstream of the first damping member to a combustion chamber;

b. flowing the working fluid through a second set of nozzles, wherein the second set of nozzles is adjacent to and spaced apart from the first set of nozzles; and c. contacting at least one nozzle in the second set of nozzles with the first damping member on at least one nozzle in the first set of nozzles, wherein the first and second set of nozzles extend axially between an end cover and the combustion chamber downstream from the end cover.

20. The method as in claim 19, further comprising contacting the at least one nozzle in the second set of nozzles with the first damping member on the at least one nozzle in the first set of nozzles, wherein the second set of nozzles includes a second damping member attached to and circumferentially surrounding at least a portion of the second set of nozzles.

* * * * *